US011112200B2

(12) United States Patent
Lawson et al.

(10) Patent No.: US 11,112,200 B2
(45) Date of Patent: Sep. 7, 2021

(54) SUPPRESSOR

(71) Applicant: Earth Outdoor Tactical L.L.C., Mountain Grove, MO (US)

(72) Inventors: Robert D. Lawson, Cabool, MO (US); Dennis D. Martin, Mountain Grove, MO (US)

(73) Assignee: Earth Outdoor Tactical L.L.C., Mountain Grove, MT (US)

( * ) Notice: Subject to any disclaimer, the term of this patent is extended or adjusted under 35 U.S.C. 154(b) by 0 days.

(21) Appl. No.: 16/673,583

(22) Filed: Nov. 4, 2019

(65) Prior Publication Data

US 2021/0131759 A1 May 6, 2021

(51) Int. Cl.
*F41A 21/30* (2006.01)
*F41A 21/48* (2006.01)

(52) U.S. Cl.
CPC ..... *F41A 21/30* (2013.01); *F41A 21/482* (2013.01)

(58) Field of Classification Search
CPC ..... F41A 21/30; F41A 21/32; F41A 21/325; F41A 21/44; F41A 21/482
See application file for complete search history.

(56) References Cited

U.S. PATENT DOCUMENTS 2,448,382 A * 8/1948 Mason ..... F41A 21/30 89/14.4
3,713,362 A * 1/1973 Charron ..... F41A 21/30 89/14.4
3,776,093 A * 12/1973 Leverance ..... F41A 21/34 89/14.4
4,291,610 A * 9/1981 Waiser ..... F41A 21/30 89/14.4
5,438,907 A * 8/1995 Reynolds ..... F41A 21/26 102/530
6,257,147 B1 * 7/2001 Davies ..... F41A 21/30 102/439

(Continued)

OTHER PUBLICATIONS

"The Sounds of Silence", Reflex Suppressors General Info, BR-Tuote of Joensuu, Finland, Mar. 23, 2009. Available at: http://www.guns.connect.fi/rs/general.html.

(Continued)

*Primary Examiner* — Derrick R Morgan
(74) *Attorney, Agent, or Firm* — Shook, Hardy & Bacon L.L.P.

(57) ABSTRACT

A suppressor, an integrally suppressed barrel system, and a method for coupling a suppressor to a firearm barrel are provided. In an embodiment, a suppressor is configured to have two distinct fittings, each of which provides a point of contact for coupling with a firearm barrel. The suppressor or integrally suppressed barrel system may comprise an expansion chamber with an expansion chamber baffle and wire mesh to alter the sonic characteristics of a report associated with the discharging of a firearm. In some embodiments, the expansion chamber baffle may be movable, allowing for modification to the sonic properties of a cold bore shot vis-à-vis subsequent shots. The method for coupling the suppressor to the firearm barrel includes engaging first and second threaded portions of the firearm barrel with corresponding threaded inner surfaces of first and second suppressor fittings.

19 Claims, 8 Drawing Sheets

(56) References Cited

U.S. PATENT DOCUMENTS

| | | | | |
|---|---|---|---|---|
| 6,374,718 | B1 * | 4/2002 | Rescigno | F41A 21/30 89/14.4 |
| 7,661,349 | B1 * | 2/2010 | Brittingham | F41A 21/34 89/14.4 |
| 7,832,323 | B1 * | 11/2010 | Davies | F41A 21/325 89/14.4 |
| 8,474,361 | B2 * | 7/2013 | Brittingham | F41A 21/30 89/14.4 |
| 9,182,187 | B1 * | 11/2015 | Griffith | F41A 21/325 |
| 10,222,162 | B2 * | 3/2019 | Adamson, Jr. | F41A 21/30 |
| 10,330,420 | B2 * | 6/2019 | Kunsky | F41A 21/325 |
| 10,365,061 | B1 * | 7/2019 | Painter | F41A 5/26 |
| 10,739,098 | B2 * | 8/2020 | Lee | F41A 21/44 |
| 2012/0152649 | A1 * | 6/2012 | Larue | F41A 21/30 181/223 |
| 2015/0090105 | A1 * | 4/2015 | Pace | F41A 21/30 89/14.4 |
| 2015/0260472 | A1 * | 9/2015 | Smith | F41A 21/30 89/14.2 |
| 2016/0003566 | A1 * | 1/2016 | Gomirato | F41A 5/28 89/193 |
| 2016/0010935 | A1 * | 1/2016 | Clarke | F41A 21/34 89/14.4 |
| 2017/0191779 | A1 * | 7/2017 | Myers | F41A 21/30 |
| 2017/0205175 | A1 * | 7/2017 | Garst | F41A 21/30 |
| 2017/0254609 | A1 * | 9/2017 | Schoenlau | F41A 21/32 |
| 2017/0299311 | A1 * | 10/2017 | Daniel | F41A 5/26 |
| 2018/0202744 | A1 * | 7/2018 | De Sousa | F41A 21/30 |
| 2018/0238653 | A1 * | 8/2018 | Kunsky | F41A 21/325 |
| 2018/0321008 | A1 * | 11/2018 | Barney | F41A 21/30 |
| 2018/0347931 | A1 * | 12/2018 | Schoppman | F41A 21/24 |
| 2019/0017773 | A1 * | 1/2019 | Myers | F41A 19/13 |
| 2019/0195589 | A1 * | 6/2019 | Lee | F41A 21/325 |
| 2020/0025490 | A1 * | 1/2020 | Facchini | F41A 21/30 |
| 2020/0025498 | A1 * | 1/2020 | Wheeler | F41A 5/26 |
| 2020/0025508 | A1 * | 1/2020 | Vabnick | F41B 9/0075 |
| 2020/0072571 | A1 * | 3/2020 | Washburn, III | F41A 21/30 |
| 2020/0166304 | A1 * | 5/2020 | Martin | F41A 21/28 |
| 2020/0182579 | A1 * | 6/2020 | Llewellyn | F41A 21/30 |

OTHER PUBLICATIONS

White, Mark, "The Use of Sound Suppressors on High-Powered Rifles", published Feb. 22, 2000, Available at: http://www.guns.connect.fi/gow/highpow.html.

International Search Report and Written Opinion received for PCT Patent Application No. PCT/US2020/058889, dated an Apr. 23, 2021, 9 pages.

* cited by examiner

SUPPRESSOR

TECHNICAL FIELD

The field relates to suppressor devices for firearms.

BACKGROUND

Firearms are carried by private citizens, law enforcement, security, and military personnel, among others, for self-defense or used for recreational purposes. Often times the report of a firearm discharge can be damaging to the ears of the firearm operator or persons nearby. This is particularly the case with respect to firearms configured to discharge centerfire rounds. Various suppressors are available for civilian recreational and/or law enforcement/military use. However, existing suppressors are configured to have a single point of attachment to the muzzle of a firearm. Those suppressors may be generally considered to be either external or integral, with the vast majority of presently available suppressors being external.

External suppressors may be generally defined as devices that are not designed to be incorporated into the routine operation of a firearm. In other words, the legal or dimensional characteristics of what is legally considered to be the "barrel" of a firearm (e.g., as defined by U.S. law) is not changed by removing an external suppressor. External suppressors, which are attached to the muzzle of a firearm, are limited by the effects of their length and weight on the handling and balance of operating the firearm. Like external suppressors, existing integral suppressors rely on a single point of attachment; however, integral suppressors are incorporated into the design of a firearm, wherein the removal of the integral suppressor (if possible) may cause undesirable effects on ballistics or firearm operation. Whether external or integral, existing suppressors, having a single point of attachment, are susceptible to loosening, whether through incidental contact between the suppressor and an object, or simply through use.

SUMMARY

This summary is intended to introduce a selection of concepts in a simplified form that are further described below in the detailed description section of this disclosure. This summary is not intended to identify key or essential features of the claimed subject matter, and it is not intended to be used as an aid in isolation for determining the scope of the claimed subject matter.

In brief, and at a high level, this disclosure describes a suppressor and integrally suppressed barrel for reducing the audible report of a projectile discharged by the operation of a firearm. In one embodiment, the suppressor may be a multicameral device, encompassed by a suppressor housing. The various chambers of the suppressor and the components therein may be configured to allow for the channeling, diffusion, cooling, and expansion of escaping propellant (exhaust) gas.

The suppressor may include two or more discrete fittings, each of which is configured to receive and mate with an exterior-threaded portion of a firearm barrel. When coupled to a firearm barrel, the suppressor and barrel may comprise an integrally suppressed barrel system. By providing for two points of attachment to a firearm barrel, the suppressor is significantly more secured, thereby increasing resistance to being jarred or knocked loose and decreasing the likelihood of a catastrophic failure due to misalignment between the suppressor and barrel. By overlapping a portion of the suppressor with the barrel, advanced sound suppression may be achieved without adding undesirable length to the firearm, while also preserving a level of desired accuracy as a function of barrel length.

By including a muzzle attachment device to the forward end of the suppressor, an external muzzle device may be coupled to the suppressor. By creating a multicameral suppressor with an optionally adjustable expansion chamber baffle, the suppressor may be configured to balance the report of a cold bore shot, vis-à-vis subsequent shot reports. Any one or more of these features may be of particular use to law enforcement and military operators, who often have the need to operate a single firearm that is capable of accurate fire at greatly reduced sound levels (e.g., to preserve stealth or to allow for communication between users during firearm operation).

In one embodiment of the present invention, a suppressor for a reducing an audible report of a firearm is provided. The suppressor includes a tubular housing having a first end and a second end opposite the first end. A first disk shaped body is disposed within the tubular housing in a first position and has a first through hole defining a first inner surface, at least a portion of the first inner surface being threaded and configured to mate with a first threaded portion of a firearm barrel. A second disk shaped body is disposed within the tubular housing in a second position and has a second through hole defining a second inner surface, at least a portion of the second inner surface being threaded and configured to mate with a second threaded portion of the firearm barrel, wherein the first position and the second position are spaced apart by a first longitudinal distance, the first longitudinal distance defining an expansion chamber.

In another embodiment hereof, an integrally suppressed barrel system is provided. The system includes a suppressor and a firearm barrel. The suppressor includes a housing, a first barrel receiving fitting disposed within the housing, and a second barrel receiving fitting disposed within the housing. The first barrel receiving fitting has a threaded through hole that defines a first inner surface and the second barrel receiving fitting has a threaded through hole that defines a second inner surface. The firearm barrel includes a first threaded portion on an outer-facing surface of the firearm barrel at a first position and a second threaded portion at a second position. A distance may separate the first threaded portion from the second portion, and at least a portion of the first barrel receiving fitting is configured to receive and mate with the first threaded portion of the firearm barrel and the second barrel receiving fitting is configured to receive and mate with the second threaded portion of the firearm barrel.

In yet another embodiment hereof, a method for coupling a suppressor to a barrel of a firearm barrel is provided. The method comprises inserting a first portion of the barrel of the firearm into a first portion of a suppressor housing, wherein the suppressor housing comprises a first threaded suppressor component and a second threaded suppressor component. The method further comprises engaging a first threaded portion of the barrel of the firearm with the first threaded suppressor component and engaging a second threaded portion of the barrel of the firearm with the second threaded suppressor component.

BRIEF DESCRIPTION OF THE DRAWINGS

The subject matter disclosed herein is described in detail with reference to the attached drawing figures, which are intended to illustrate non-limiting examples of the disclosed subject matter related to suppressors and integrally suppressed barrel, in which like numerals refer to like elements, wherein.

DETAILED DESCRIPTION

The subject matter of the present invention is described herein to meet statutory requirements. However, this description is not intended to limit the scope of the invention. Rather, the claimed subject matter may be embodied in other ways, to include different features, and/or combinations of features, similar to those described in this disclosure, and in conjunction with other present or future technologies. Throughout this disclosure, certain terminology may be used in common terms except when specifically defined herein. For example, as used herein, the terms "approximately" or "substantially," when used to describe a particular number, may be used to refer to a range of numbers within 10% of the particular number. The terms "forward" and "rearward" may be used according to their common understanding in view of the discharging end of a device (e.g., suppressor or firearm barrel without suppressor) being a forward end (e.g., a muzzle). "Longitudinal" means the direction along or parallel to the longitudinal axis of the suppressor or firearm barrel (i.e., the axis in which a bullet would pass as it is being discharged from a firearm). The term "threads" or phrase "plurality of threads" are used to described any one or more threads, used according to their common understanding, to describe a continuous thread or a series of discontinuous threads that work cooperatively to mate and engage with another threaded feature.

At a high level, the subject matter of this disclosure relates generally to firearm suppressors, an integrally suppressed firearm barrel, and a method for coupling a suppressor to a firearm barrel. In particular, in one disclosed embodiment, a suppressor for reducing the report of a discharging bullet is provided. In such an embodiment, the suppressor includes a first threaded component and a second threaded component interiorly disposed along a longitudinal axis of the suppressor. The first threaded component is configured to engage and mate with a first threaded portion of a firearm barrel. The second threaded component is configured to engage and mate with a second threaded portion of the firearm barrel, wherein a minimum longitudinal distance separates the first and second threaded components. When coupled to the firearm barrel, the suppressor and firearm barrel cooperate to form an integrally suppressed firearm barrel system. Example embodiments of these suppressors and systems, as well as methods for coupling a suppressor to a firearm barrel, are discussed in further detail below with reference to FIGS. 1-9.

Figure 1:
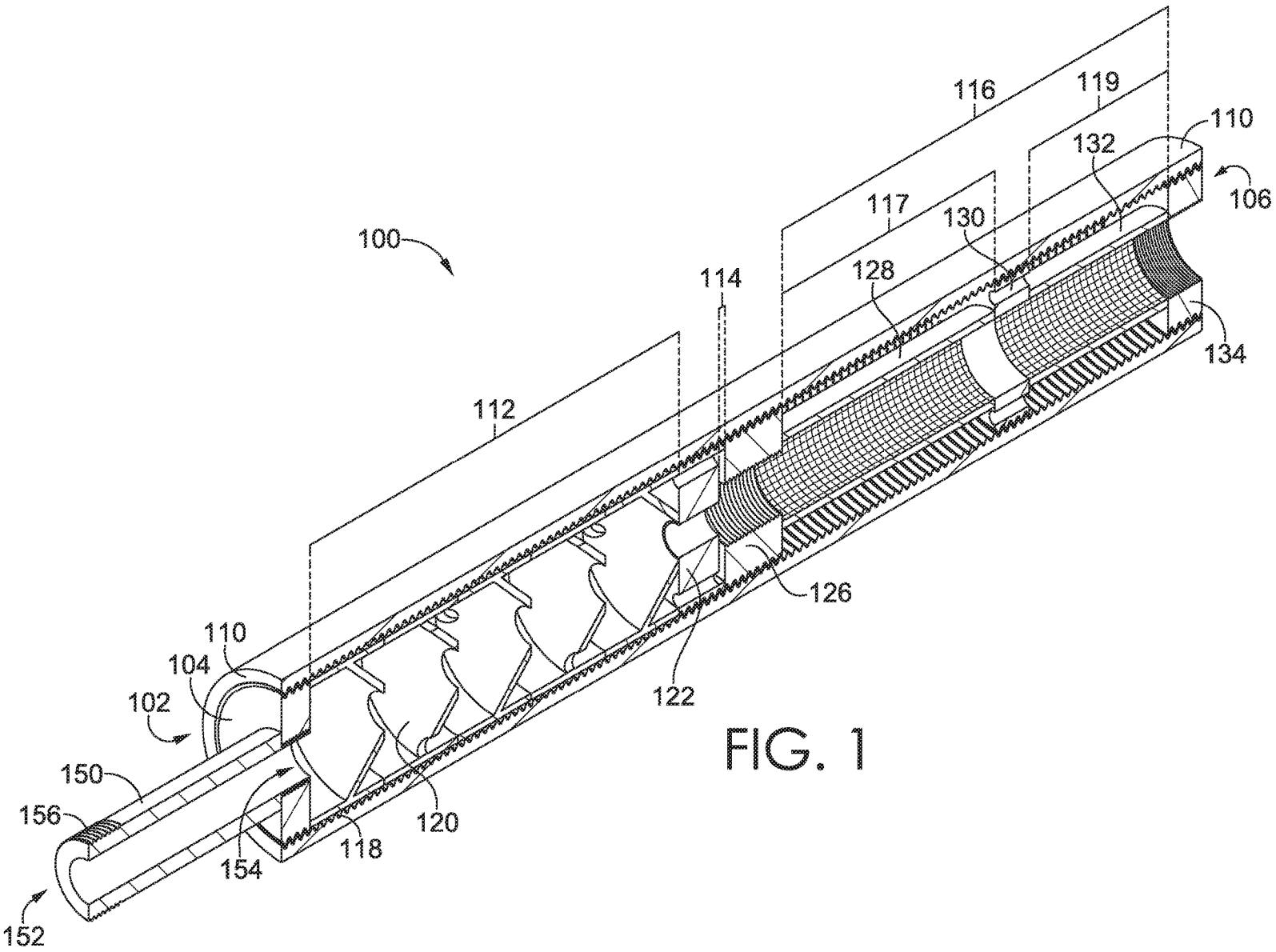
FIG. 1 is a cross-sectional perspective view of a suppressor in accordance with a first embodiment of the invention.

FIG. 1 illustrates a first embodiment of a suppressor 100 in accordance with the present invention. The suppressor 100 includes a housing 110 which, though depicted as being a cylindrical-shaped tube, may take the form of any geometrically desirable configuration. For example, the housing 110 may be configured to be box shaped in some aspects, so as to reduce the likelihood that the suppressor 100 obstructs certain low-profile iron sights that are native to some firearms to which it may be desirable to attach the suppressor 100. The suppressor housing 110 may be of any desirable length; for example, the suppressor housing 110 may have an overall length in a range of 6-12 inches (e.g., 10 inches). With respect to a tubular-shaped suppressor housing, the suppressor housing may have an outer diameter in a range of 1.25-3 inches (e.g., 1.75 inches) and an inner diameter in a range of 1-2.75 inches (e.g., 1.5 inches).

In some aspects, the inner surface of the suppressor housing 110 may comprise one or more threaded portions 118. The one or more threaded portions may be threaded in accordance with American National Standards Institute (ANSI) standard ANSI/ASME B1.1-1989 (R2001) (hereinafter referred to with reference to "ANSI" and any subsequent threading dimension(s)) and have Unified Fine (UNF) threads (e.g., a thread size of ANSI 1.5 inches nominal with a thread spacing of 12 threads per inch).

For example, the inner surface of the suppressor housing 110 may be continuously threaded between a first end 102 (i.e., a forward end or discharging end, from which a projectile fired by a firearm is discharged from the suppressor 100) and a second end 106 (i.e., a rearward end, which is capable for receiving at least a portion of a barrel of the firearm), opposite the first end 102, of the suppressor 100. Such an embodiment may be particularly useful for user-serviceable suppressors, in order that users may disassemble, reassemble, replace, or reconfigure internal components as desired.

In other aspects, the inner surface of the suppressor housing 110 may not comprise any threaded portion. An unthreaded inner surface may be desirable in embodiments where the suppressor 100 is not user-serviceable (that is, the suppressor 100 is not intended to be disassembled/cleaned by the user), in order to reduce time and cost in manufacturing. Whether the inner surface of the suppressor 110 is threaded, partially threaded, or unthreaded, any one or more components of the suppressor (e.g., a plurality of fittings that define various chambers) may be held in place via any one or more structural or chemical methods (e.g., chemical adhesive, pinning, welding, threads, barriers, or the like).

In some aspects, the suppressor 100 may additionally comprise a muzzle device adapter 150. Conventional suppressors do not allow for separate, external muzzle devices to be coupled to the discharging end of the suppressor. In some instances, it may be desirable for users to attach such an external muzzle device, such as a flash hider or muzzle brake (e.g., a breacher muzzle brake), to the first end 102 of the suppressor.

In order to accommodate such a device, the muzzle device adapter 150 comprises a first end 152 and a second end 154 opposite the first end 152, wherein the second end 154 is the portion of the muzzle device adapter 150 through which a discharging projectile enters and wherein the first end 152 is the portion of the muzzle device adapter 150 through which the discharging projectile exits. In order to receive an external muzzle device, at least a portion of the first end 152 of the muzzle device adapter 150 may be threaded. In such an aspect, a threaded portion 156 of the first end 152 may have Unified Extra Fine (UNEF) threads in a range of 0.5-1 inches nominal with a thread spacing in a range of 20-31 threads per inch (e.g., a thread size of ANSI ⅝ inches nominal with a thread spacing of 24 threads per inch). The muzzle device adapter may be of any desirable length; for example, it may have a length in a range of 0.5-3 inches (e.g., 2 inches).

In some aspects, the muzzle device adapter 150 may be removable from the suppressor 100. In such an aspect, a second end 154 may comprise a threaded portion that is configured to mate with a threaded portion of the suppressor 100 (e.g., a threaded inner surface of a muzzle seal retainer 104) and permit the muzzle device adapter 150 to be mounted to or removed from the suppressor 100. In other aspects, such as when an overall length is desired to be constant because of jurisdictional overall/barrel length requirements, the muzzle device adapter 150 may not be removable. In such an aspect, the second end 154 of the muzzle device adapter 150 may be threaded or unthreaded, and may be welded, pinned, unitarily formed with, or otherwise coupled to the suppressor 100 in such a manner that a user cannot remove the muzzle device adapter 150 from the suppressor 100 without tools and/or without damaging one or more components of the suppressor 100.

As mentioned, the suppressor 100 may have a plurality of fittings that define one or more chambers of the suppressor 100. In aspects, the suppressor 100 may have any combination of a blast chamber 112, a mid-seal chamber 114, and an expansion chamber 116. For example, in some aspects, the suppressor 100 may not comprise a mid-seal chamber 114. In one embodiment, the suppressor 100 may comprise, from the forward-most end to the rearward end, the muzzle device adapter 150, the blast chamber 112, the mid-seal chamber 114, and the expansion chamber 116. The length of the various chambers may vary based on the desired overall length of the suppressor 100 and/or the caliber of the firearm(s) that the suppressor 100 will be coupled to.

In one aspect, the longitudinal length of the blast chamber 112 and the expansion chamber 116 may be approximately equal and each greater than the longitudinal length of the mid seal chamber 114 (if it is present). In another aspect, the longitudinal length of the blast chamber 112 may not be equal to that of the expansion chamber 116. In any aspect, the blast chamber 112 may have a longitudinal length in a range of 2-6 inches (e.g., approximately 4 inches), the mid-seal chamber 114 may have a longitudinal length in a range of $1/16^{th}$-1 inch (e.g., approximately ⅛ inch), and the expansion chamber 116 may have a longitudinal length in a range of 2-6 inches (e.g., approximately 4 inches).

Figure 2:
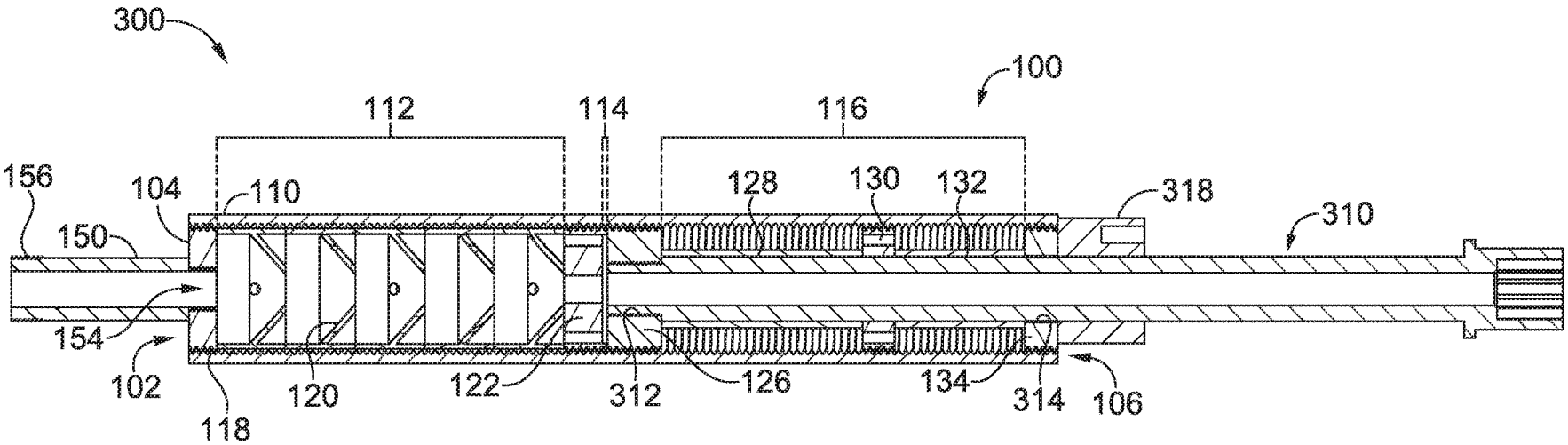
FIG. 2 is a cross-sectional elevation view of an integrally suppressed barrel system in an assembled state, in accordance with a second embodiment of the invention.

The blast chamber 112 may be said to be the forward-most chamber of the suppressor 100 and is generally defined as the space between a muzzle seal retainer 104 and a blast chamber fitting 122. A forward end of the blast chamber 112 is defined by a muzzle seal retainer 104 and a rearward end of the blast chamber 112 is defined by a blast chamber fitting 122. Disposed within the suppressor housing 110, between the muzzle seal retainer 104 and the blast chamber fitting 122, the blast chamber 112 may include one or more baffles 120 (e.g., 1-6 baffles). The one or more baffles 120 may be of any suitable type, including k-type or m-type baffles, that permit an amount of exhaust (i.e., propellant) gas to be redirected and cooled before exiting the suppressor 100. In the illustrated embodiment, and as best seen in FIG. 2, the baffles 120 may be conical or frustoconical in shape. Other shapes may also be suitable for the baffles 120.

The muzzle seal retainer 104 is a fitting disposed at or near the first end 102 of the suppressor 100 that is generally configured to at least partially seal the discharging end of the suppressor 100. The structure of the muzzle seal retainer 104 allows the discharging projectile to exit the suppressor 100 while also preventing and/or restricting the amount of propellant gas that is directed back within the suppressor as opposed to escaping through the discharge end of the suppressor.

Figure 4:
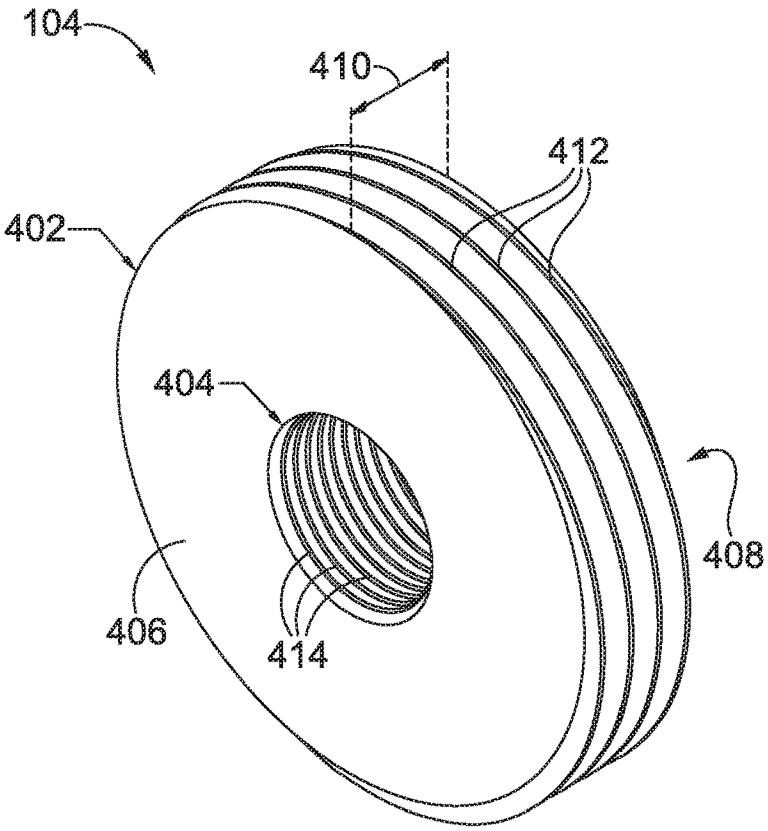
FIG. 4 is a perspective view of a muzzle seal retainer, in accordance with one or more embodiments of the present disclosure.

As seen in greater detail in FIG. 4, the muzzle seal retainer 104 may be a disk shaped body or may be any shape that corresponds to and/or is suitable for mating with the geometry of the inner surface of the suppressor housing 110 (e.g., rectangular for a rectangular housing or round for a cylindrical housing). The muzzle seal retainer 104 may be said to have an outer surface 402 having an outer diameter in the range of 1-2 inches; for example, the outer diameter may be approximately 1.5 inches. The muzzle seal retainer 104 may also be said to have a through hole defining an inner surface 404 having an inner diameter in the range of 0.25-0.75 inches; for example, the inner diameter may be approximately 0.459 inches.

The muzzle seal retainer 104 may be further said to have a first face 406 and a second face 408 opposite the first face 406. Though shown as planar, one or more of the first face 406 and the second face 408 may be convex, concave, or any other desirable configuration, each of which may have varying effects on the sonic and/or ballistic characteristics of the suppressor. In some aspects, either the first face 406 or the second face 408 of the muzzle seal retainer 104 may face towards the forward end of the suppressor.

Each of the first face 406 and the second face 408 may be continuous in a plane spanning the distance from the outer surface 402 to the inner surface 404; that is, other than the through hole that defines the inner surface 404, the muzzle seal retainer 104 may be configured to not include apertures that extend from the first face 406 to the second face 408. In other aspects, the muzzle seal retainer 104 may include one or more apertures in the first face 406 and/or the second face 408 that extend toward or all the way through to the opposite face, wherein a longitudinal axis of each of the one or more apertures is parallel to a longitudinal axis of the suppressor 100.

The muzzle seal retainer 104 may be said to have a thickness 410, as measured perpendicular to the first face 406 and/or the second face 408. In some aspects, the thickness 410 may be in the range of 0.25-0.5 inches; for example, the thickness 410 may be approximately 0.313 inches. In some aspects, the outer surface 402 may comprise outer surface threads 412, which, in some aspects, may be configured to mate with the threaded inner surface 118 of the suppressor housing 110 of FIG. 1. For example, the outer surface threads 412 may be UNF threads (e.g., ANSI 1.5 inches nominal with a thread spacing of 12 threads per inch). The inner surface 404 may comprise inner surface threads 414, for example, configured to mate with the muzzle device adapter 150 of FIGS. 1-3C. In an exemplary aspect, the inner surface threads 414 may be UNEF threads (e.g., ANSI 0.5 inches nominal with a thread spacing of 28 threads per inch, or ⅝ inches nominal with a thread spacing of 24 threads per inch).

Returning to FIG. 1, the rear boundary of the blast chamber 112 is defined by the blast chamber fitting 122. In aspects where the inner surface of the suppressor housing 110 is unthreaded or where the one or more baffles 120 are otherwise not held in place, the blast chamber fitting 122 may hold the one or more baffles 120 in place. The blast chamber fitting 122 may additionally or alternatively govern the amount of exhaust gas that passes between the blast chamber 112 and the mid seal chamber 114, which affects the overall ballistic and/or sonic performance of the suppressor 100.

Figure 5:
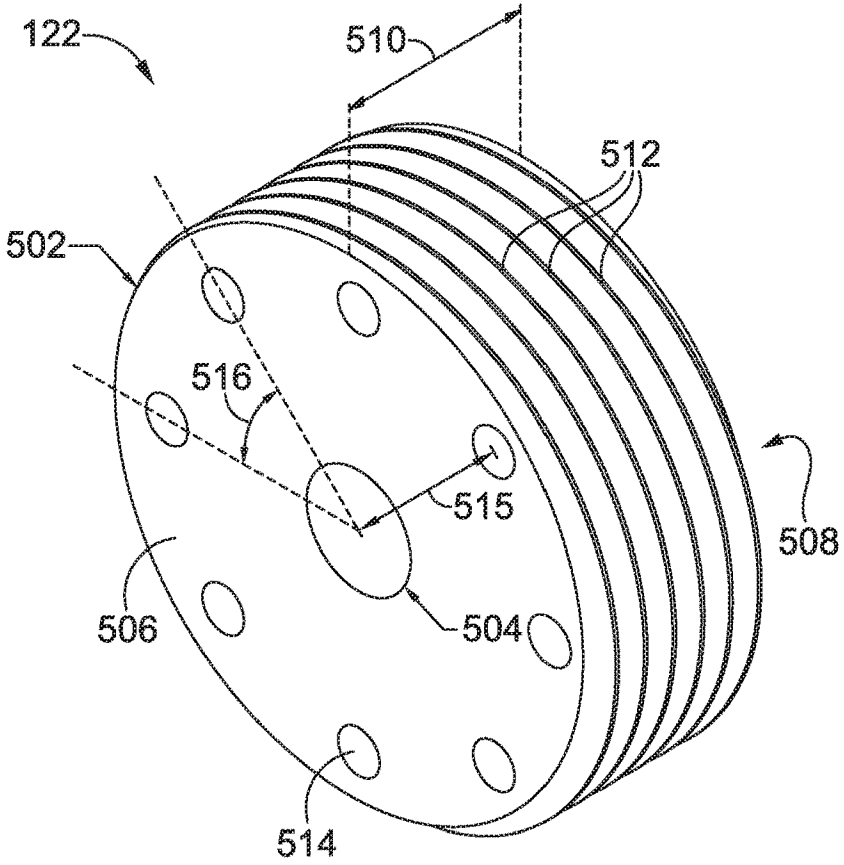
FIG. 5 is a perspective view of a blast chamber fitting, in accordance with one or more embodiments of the present disclosure.

As seen in greater detail with respect to FIG. 5, the blast chamber fitting 122 may be a disk shaped body or may be any shape that corresponds to and/or is suitable for mating with the geometry of the inner surface of the suppressor housing 110 (e.g., rectangular for a rectangular housing or round for a cylindrical housing). The blast chamber fitting 122 may be said to have an outer surface 502 having an outer diameter in the range of 1-2 inches; for example, the outer diameter may be approximately 1.5 inches.

The blast chamber fitting 122 may also be said to have a through hole defining an inner surface 504 having an inner diameter in the range of 0.25-0.75 inches; for example, the inner diameter may be approximately 0.31 inches. In some aspects, the inner diameter of the blast chamber fitting 122 is less than the inner diameter of the muzzle seal retainer 104 of FIG. 4.

The blast chamber fitting 122 may be further said to have a first face 506 and a second face 508 opposite the first face 506. Though shown as planar, one or more of the first face 506 and the second face 508 may be convex, concave, or any other desirable configuration each of which may have varying effects on the sonic and/or ballistic characteristics of the suppressor. In some aspects, either the first face 506 or the second face 508 of the blast chamber fitting 122 may face towards the discharging end of the suppressor.

In addition to the through hole that defines the inner surface 504, each of the first face 506 and the second face 508 of the blast chamber fitting 122 may comprise one or more apertures 514 that extend partially or completely through the blast chamber fitting 122, from the first face 506 to the second face 508, wherein a longitudinal axis of each of the one or more apertures is parallel to the longitudinal axis of the suppressor 100. When extending all the way through the blast chamber fitting 122, the apertures 514 allow exhaust gas to pass through the blast chamber fitting 122 between the blast chamber 112 and the mid seal chamber 114. In aspects, the blast chamber fitting 122 may comprise 1-10 apertures; for example, the blast chamber fitting 122 may comprise 2, 4, or 8 apertures, depending on the amount of exhaust gas desired to be allowed to pass through the blast chamber fitting 122. Each of the one or more apertures 514 may be circular, or any other desired geometric shape, and may have the same or varying diameters. Each of the one or more apertures 514 may have a diameter in the range of 0.0625-0.25 inches, depending on the amount of exhaust gas desired to be allowed to pass therethrough; for example, the aperture diameter may be 0.125 inches.

Each of the one or more apertures 514 may be centered at a range 515 from the center of the through hole defining the inner surface 504, wherein the range 515 is between 25% and 80% (e.g., approximately 75%) of a radius of the first face 506 or the second face 508 (i.e., the distance from the center of the through hole defining the inner surface 504 to the outer surface 502). The range 515 may be constant (i.e., the same for all apertures 514) or it may be variable (i.e., one or more apertures 514 may have different ranges 515).

In aspects where the blast chamber fitting 122 comprises a plurality of apertures 514, an inter-aperture angle 516 may be said to separate each of the plurality of apertures 514, with respect to the center of the blast chamber fitting 122. The inter-aperture angle 516 may be constant (i.e., the inter-aperture angle 516 may be the same between any two adjacent apertures) or it may be variable (i.e., the inter-aperture angle 516 may be different between two pairs of adjacent apertures). The inter-aperture angle 516 may be in a range of 30-180 degrees; for example, the inter-aperture angle 516 may be 36 degrees, 45 degrees, 60 degrees, or 90 degrees. In yet other aspects, the blast chamber fitting 122 may not comprise one or more apertures that extend from the first face 506 to the second face 508, other than the through hole opening defined by the inner surface 504.

The blast chamber fitting 122 may be said to have a thickness 510, as measured perpendicular to the first face 506 and/or the second face 508. In some aspects, the thickness 510 may be in the range of 0.25-0.75 inches; for example, the thickness 510 may be approximately 0.5 inches. In some aspects, the outer surface 502 may comprise outer surface threads 512, which, in some aspects, may be configured to mate with the threaded inner surface 118 of the suppressor housing 110 of FIG. 1; for example, the outer surface threads 512 may be UNF threads (e.g., ANSI 1.5 inches nominal with a thread spacing of 12 threads per inch).

Returning to FIG. 1, the suppressor 100 may comprise a mid-seal chamber 114 that separates the blast chamber fitting 122 from the mid seal mount 126. Though not depicted in FIG. 1, in some aspects, the suppressor 100 may not comprise a mid-seal chamber 114, in which case the blast chamber fitting 122 may abut, be in at least partial contact with, or be integrally formed with, the mid seal mount 126. The mid-seal chamber 114 generally governs the passage of the exhaust gas between the blast chamber 112 and the expansion chamber 116; therefore, varying the size of the mid-seal chamber is one way to change the ballistic and/or sonic characteristics of the suppressor 100.

In addition to governing the flow of exhaust gas between the mid-seal chamber 114 and the expansion chamber 116, the mid-seal mount 126 is configured to be a first, forward point of attachment to a firearm barrel. As seen in greater detail with respect to FIG. 6, the mid-seal mount 126 may be a disk shaped body or may be any shape that corresponds to and/or is suitable for mating with the geometry of the inner surface of the suppressor housing 110 (e.g., rectangular for a rectangular housing or round for a cylindrical housing). The mid-seal mount 126 may be said to have an outer surface 602 having an outer diameter in the range of 1-2 inches; for example, the outer diameter may be approximately 1.5 inches.

The mid-seal mount 126 may also be said to have a through hole defining an inner surface 604 having an inner diameter in the range of 0.25-1.25 inches; for example, the inner diameter may be approximately 0.565 inches. In some aspects, the inner diameter of the mid-seal mount 126 is greater than the inner diameter of the blast chamber fitting 122 of FIG. 5. The mid-seal mount 126 may be further said to have a first face 606 and a second face 608 opposite the first face 606. Though shown as planar, one or more of the first face 606 and the second face 608 may be convex, concave, or any other desirable configuration, each of which may have varying effects on the sonic and/or ballistic characteristics of the suppressor. In some aspects, either the first face 606 or the second face 608 of the mid-seal mount 126 may face towards the discharging end of the suppressor.

In addition to the through hole that defines the inner surface 604, each of the first face 606 and the second face 608 of the mid-seal mount 126 may comprise one or more apertures 614 that extend into or through the mid-seal mount 126, from the first face 606 to the second face 608, wherein a longitudinal axis of each of the one or more apertures 614 is parallel to the longitudinal axis of the suppressor 100. When extending all the way through the mid-seal mount 126, the apertures 614 allow exhaust gas to pass through the mid-seal mount 126 between the mid seal chamber 114 and the expansion chamber 116. In aspects, the mid-seal mount 126 may comprise 1-10 apertures; for example, the mid-seal mount 126 may comprise 2, 4, or 8 apertures. Each of the one or more apertures 616 may be circular, or any other desired geometric shape, and may have the same or varying diameters. Each of the one or more apertures 616 may have a diameter in the range of 0.0625-0.375 inches, depending on the amount of exhaust gas desired to be allowed to pass therethrough; for example, the aperture diameter may be 0.188 inches.

Each of the one or more apertures 616 may be centered at a range 615 from the center of the through hole defining the inner surface 604, wherein the range 615 is between 25% and 80% (e.g., approximately 70%) of a radius of the first face 606 or the second face 608 (i.e., the distance from the center of the through hole defining the inner surface 604 and the outer surface 602). The range 615 may be constant (i.e., the same for all apertures 616) or it may be variable (i.e., one or more apertures 616 may have different ranges 615).

In aspects where the mid-seal mount 126 comprises a plurality of apertures 616, an inter-aperture angle 616 may be said to separate each of the plurality of apertures 616, with respect to the center of the mid-seal mount 126. The inter-aperture angle 616 may be constant (i.e., the inter-aperture angle 616 may be the same between any two adjacent apertures) or it may be variable (i.e., the inter-aperture angle 616 may be different between two pairs of adjacent apertures). The inter-aperture angle 616 may be in a range of 30-180 degrees; for example, the inter-aperture angle 616 may be 45 degrees, 60 degrees, 90 degrees, or 120 degrees.

The mid-seal mount 126 may be said to have a thickness 610, as measured perpendicular to the first face 606 and/or the second face 608. In some aspects, the thickness 610 may be in the range of 0.25-1 inches; for example, the thickness 610 may be approximately 0.625 inches. In some aspects, the outer surface 602 may comprise outer surface threads 612, which, in some aspects, may be configured to mate with the threaded inner surface 118 of the suppressor housing 110 of FIG. 1; for example, the outer surface threads 612 may be UNF threads (e.g., ANSI 1.5 inches nominal with a thread spacing of 12 threads per inch).

Figure 3A:
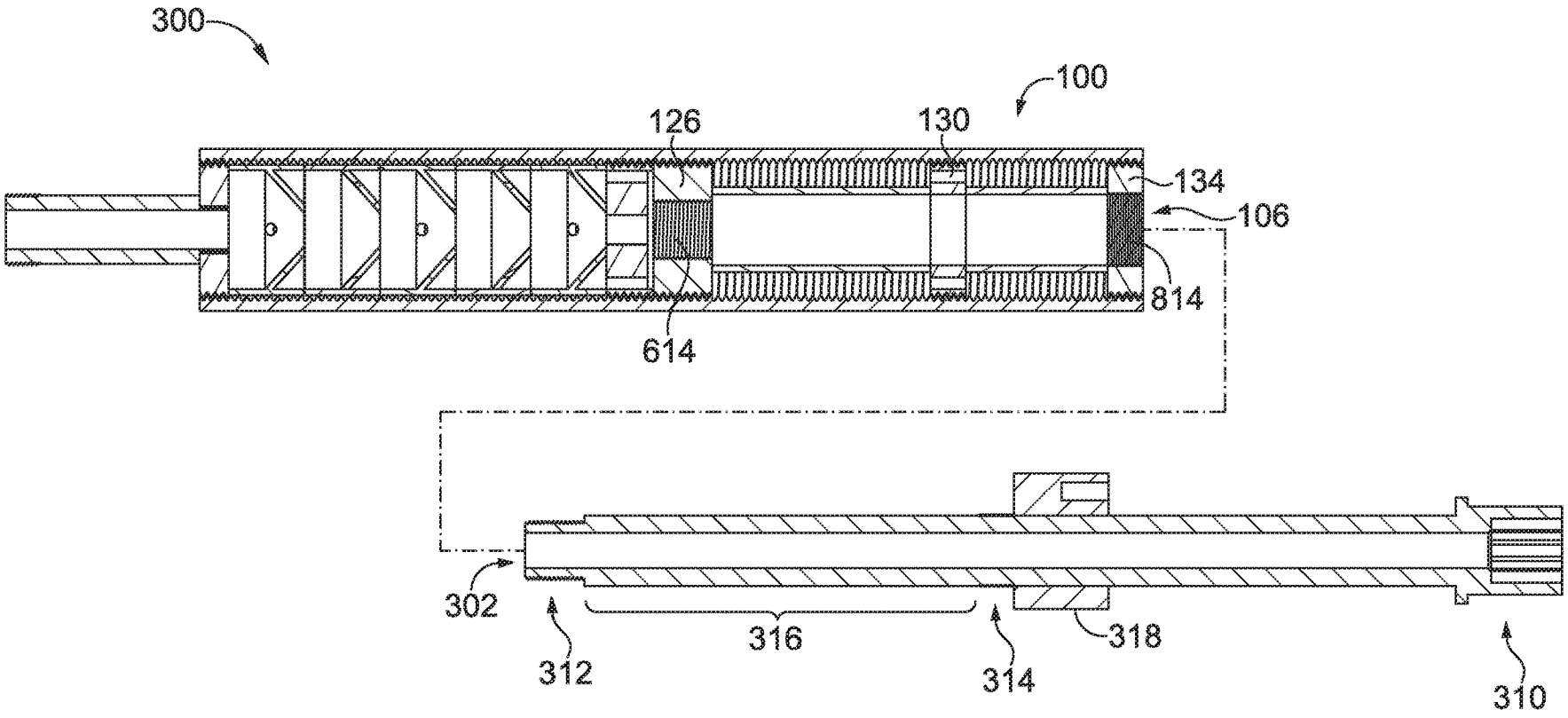
FIG. 3A is a cross-sectional elevation view of the integrally suppressed barrel system of FIG. 2 in a partially disassembled state.
Figure 3B:
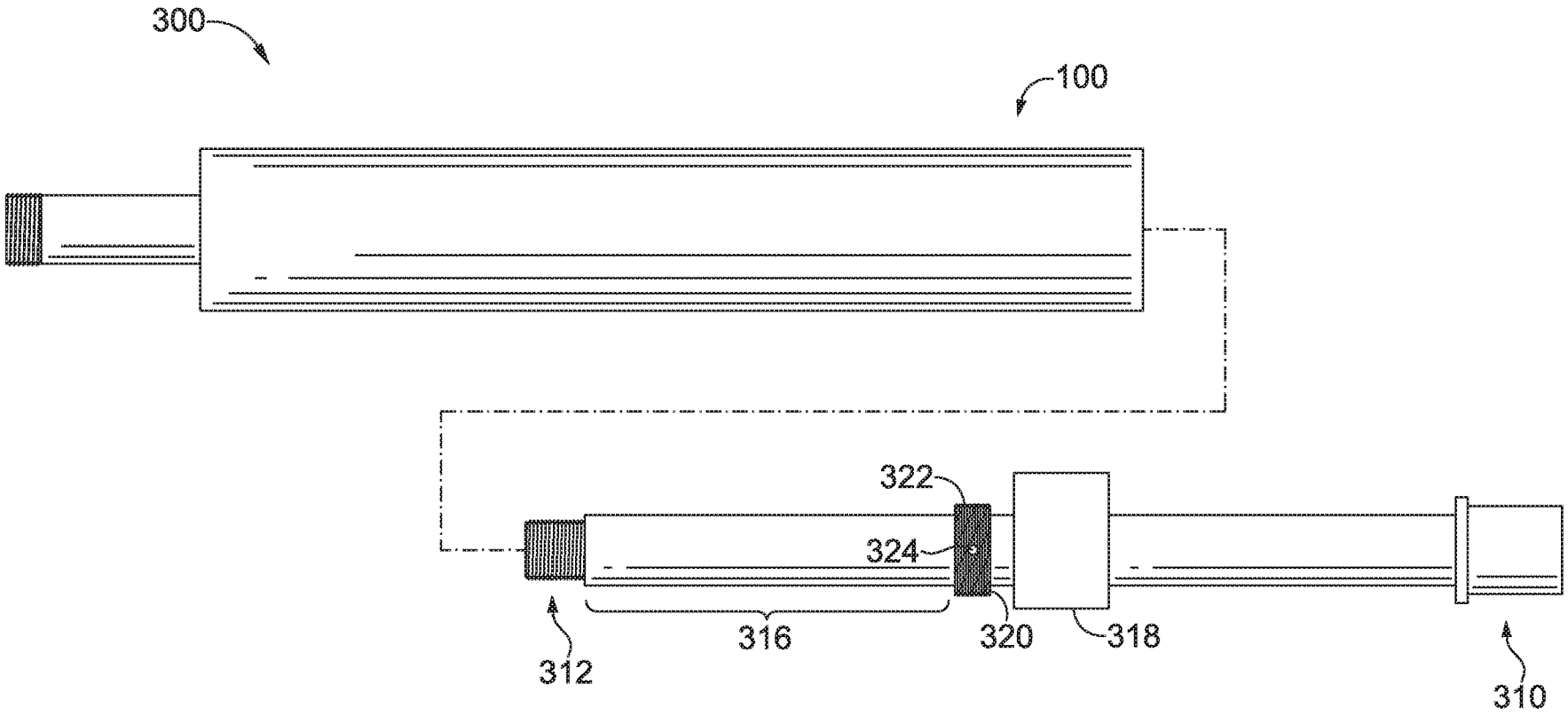
FIG. 3B is an elevation view of a modified version of the integrally suppressed barrel system of FIG. 2 in a partially disassembled state.

The inner surface 604 may comprise inner surface threads 614, for example, configured to receive and mate with a threaded first, forward portion of a firearm barrel (e.g., the barrel itself, or an external fitting that is coupled to the barrel), such as the firearm barrel 310 of FIGS. 2-3B. Because many modern firearms are configured with removable muzzle devices having varying threading configurations, the inner surface threads 614 may be threaded in any desirable configuration that enables the inner surface 604 of the mid-seal mount 126 to be coupled to existing/native (or added) muzzle threading. In an exemplary aspect, the inner surface threads 614 may be UNEF threads (e.g., ANSI 0.675 inches nominal with a thread spacing of 24 threads per inch), such as those that are native to AR-15 style firearms.

Returning to FIG. 1, the suppressor 100 includes an expansion chamber 116. The expansion chamber 116 may be a single chamber, or it may be divided into a forward expansion chamber 117 and a rear expansion chamber 119. In aspects wherein the expansion chamber 116 is divided, an expansion chamber baffle 130 may separate and at least partially define the forward expansion chamber 117 and the rear expansion chamber 119. In an embodiment of the suppressor 100 wherein the inner surface of the housing 110 is at least partially threaded along a length of the expansion chamber 116, an outer surface 702 (seen in FIG. 7) of the expansion chamber baffle 130 may comprise outer surface threads 712 that interact with the threaded inner surface 118 of the suppressor housing 110. In such an embodiment, the interaction of the threaded expansion chamber baffle 130 and the threaded inner surface 118 may permit the forward and rearward adjustment of the expansion chamber baffle 130 within the expansion chamber 116. By moving the location of the expansion chamber baffle 130, the audible signature of the suppressor 100 may be modified to balance the audible signature of a first fired projectile (i.e., a cold bore shot) and subsequent fired projectiles (this is due to the expansion chamber baffle's 130 ability to govern the rate that exhaust gas proceeds into the rear expansion chamber 119 and displaces cold air (relative to the temperature of the exhaust gas) and/or oxygen.

In other embodiments that feature the expansion chamber baffle 130, the location of the expansion chamber baffle 130 along the longitudinal length of the expansion chamber 116 may be fixed. In such an embodiment, the forward expansion chamber 117 and the rear expansion chamber 119 may have equal longitudinal lengths or different longitudinal lengths in a range of 1-5 inches (e.g., 2 inches).

In aspects, one or more of the forward expansion chamber 117 and the rear expansion chamber 119 may comprise one or more wrappings of a wire mesh to act as a heat sink for cooling the exhaust gas; for example, the forward expansion chamber 117 may comprise a first wire mesh 128 and/or the rear expansion chamber 119 may comprise a second wire mesh 132. Each of the first wire mesh 128 and/or the second wire mesh 132 may be a metallic material (e.g., stainless steel, copper, or the like), may be of a fine gage (e.g., approximately 27 gage), have a small opening width (e.g., approximately 0.03 inches), and have one or more wrappings (e.g., 3-4 wrappings) through which a firearm barrel would pass when inserted into the suppressor 100.

Figure 7:
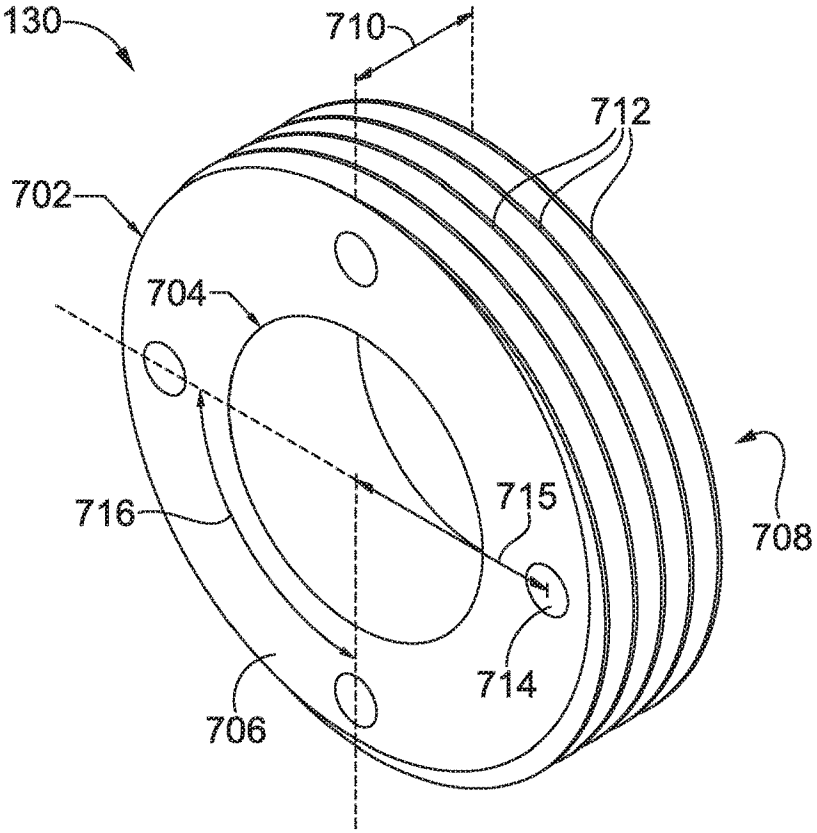
FIG. 7 is a perspective view of an expansion chamber baffle, in accordance with one or more embodiments of the present disclosure.

The expansion chamber baffle 130 is configured to form a passage through which a portion of a firearm barrel 310 may pass, and is seen in greater detail with respect to FIGS. 2 and 7. The expansion chamber baffle 130 may be a disk shaped body or may be any shape that corresponds to and/or is suitable for mating with the geometry of the inner surface of the suppressor housing 110 (e.g., rectangular for a rectangular housing or round for a cylindrical housing). The expansion chamber baffle 130 may be said to have an outer surface 702 having an outer diameter in the range of 1-2 inches; for example, the outer diameter may be approximately 1.5 inches. The expansion chamber baffle 130 includes a through hole defining an inner surface 704 having an inner diameter in the range of 0.25-1.25 inches; for example, the inner diameter may be approximately 0.75 inches. The through hole defining inner surface 704 is the passage through which a portion of the firearm barrel 310 passes when the suppressor 100 is mounted to the firearm.

Figure 6:
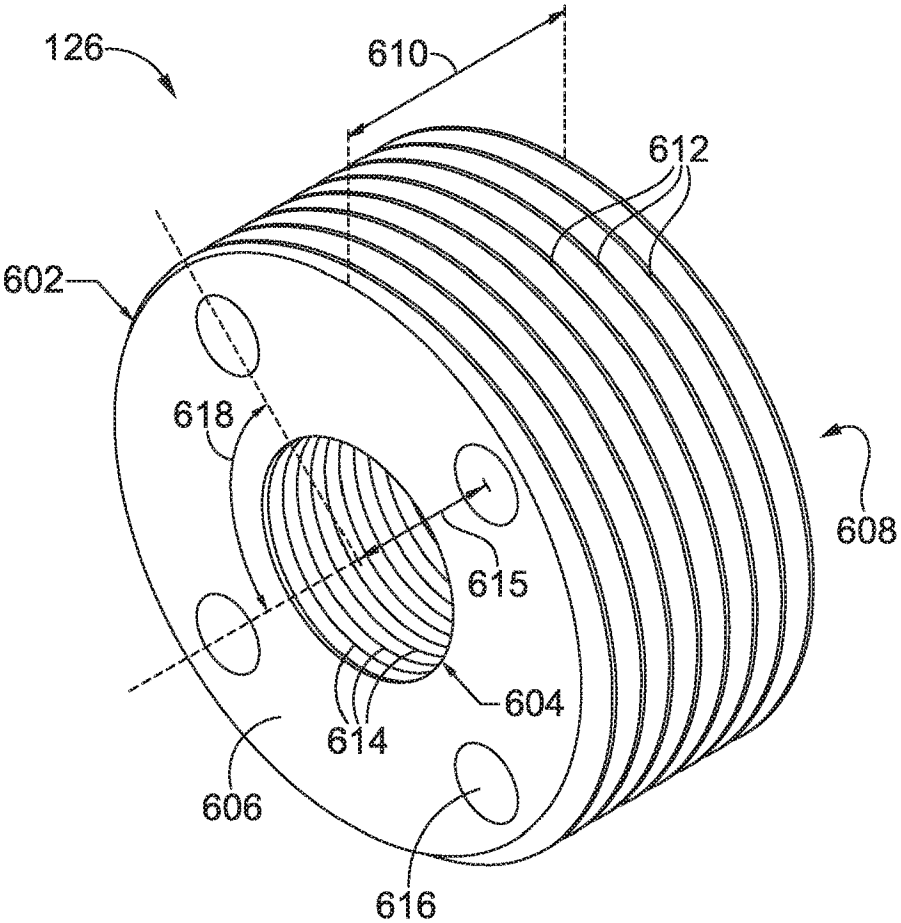
FIG. 6 is a perspective view of a mid-seal mount, in accordance with one or more embodiments of the present disclosure.

In some aspects, the inner diameter of the expansion chamber baffle 130 is greater than the inner diameter of the mid-seal mount 126 of FIG. 6; in other aspects, the inner diameter of the expansion chamber baffle 130 is approximately equal to the inner diameter of the mid-seal mount 126. The expansion chamber baffle 130 may be further said to have a first face 706 and a second face 708 opposite the first face 706. Though shown as planar, one or more of the first face 706 and the second face 708 may be convex, concave, or any other desirable configuration each of which may have varying effects on the sonic and/or ballistic characteristics of the suppressor. In some aspects, either the first face 706 or the second face 708 of the expansion chamber baffle 130 may face towards the discharging end of the suppressor 100.

In addition to the through hole that defines the inner surface 704, each of the first face 706 and the second face 708 of the expansion chamber baffle 130 may comprise one or more apertures 714 that extend into or through the expansion chamber baffle 130, from the first face 706 to the second face 708, wherein a longitudinal axis of each of the one or more apertures is parallel to the longitudinal axis of the suppressor 100. When extending all the way through the expansion chamber baffle 130, the apertures 714 allow exhaust gas to pass through the expansion chamber baffle 130 between the forward expansion chamber 117 and the rear expansion chamber 119. In aspects, the expansion chamber baffle 130 may comprise 1-10 apertures; for example, the expansion chamber baffle 130 may comprise 2, 4, or 8 apertures. Each of the one or more apertures 714 may be circular, or any other desired geometric shape, and may have the same or varying diameters. Each of the one or more apertures 714 may have a diameter in the range of 0.0625-0.25 inches, depending on the amount of exhaust gas desired to be allowed to pass therethrough; for example, the aperture diameter may be 0.125 inches.

Each of the one or more apertures 714 may be centered at a range 715 from the center of the through hole defining the inner surface 704, wherein the range 715 is between 25% and 80% (e.g., approximately 75%) of a radius of the first face 706 or the second face 708 (i.e., the distance from the center of the through hole defining the inner surface 704 and the outer surface 702). The range 715 may be constant (i.e., the same for all apertures 714) or it may be variable (i.e., one or more apertures 714 may have different ranges 715).

In aspects where the expansion chamber baffle 130 comprises a plurality of apertures, an inter-aperture angle 716 may be said to separate each of the plurality of apertures 714, with respect to the center of the expansion chamber baffle 130. The inter-aperture angle 716 may be constant (i.e., the inter-aperture angle 716 may be the same between any two adjacent apertures) or it may be variable (i.e., the inter-aperture angle 716 may be different between two pairs of adjacent apertures). The inter-aperture angle 716 may be in a range of 30-180 degrees; for example, the inter-aperture angle 716 may be 45 degrees, 60 degrees, 90 degrees, or 120 degrees. In yet other aspects, the expansion chamber baffle 130 may not comprise one or more apertures that extend from the first face 706 to the second face 708, other than the through hole opening defined by the inner surface 704.

The expansion chamber baffle may be said to have a thickness 710, as measured perpendicular to the first face 706 and/or the second face 708. In some aspects, the thickness 510 may be in the range of 0.25-0.75 inches; for example, the thickness 710 may be approximately 0.375 inches. In some aspects, the outer surface 702 may comprise outer surface threads 712, which, in some aspects, may be configured to mate with the threaded inner surface 118 of the suppressor housing 110 of FIG. 1; for example, the outer surface threads 712 may be UNF threads (e.g., ANSI 1.5 inches nominal with a thread spacing of 12 threads per inch).

Returning to FIG. 1, in embodiments of the suppressor 100 that do not comprise an expansion chamber baffle 130, the expansion chamber 116 may have a longitudinal length in a range of 1-6 inches (e.g., 4.625 inches). In such an embodiment, the expansion chamber 116 may comprise a wire mesh having any one or more properties of the first wire mesh 128 or second wire mesh 132, along at least a portion of the longitudinal length of the expansion chamber baffle 116.

The rear boundary of the expansion chamber 116 or the rear expansion chamber 119 is defined by the base seal mount 134. The base seal mount 134 acts as a rear seal for the suppressor 100, preventing the backward expulsion of exhaust gas and acting as a second point of attachment of the suppresser 100 to the barrel 310 of a firearm. As seen in greater detail with respect to FIG. 8, the base seal mount 134 may be a disk shaped body or may be any shape that corresponds to and/or is suitable for mating with the geometry of the inner surface of the suppressor housing 110 (e.g., rectangular for a rectangular housing or round for a cylindrical housing). The base seal mount 134 may be said to have an outer surface 802 having an outer diameter in the range of 1-2 inches; for example, the outer diameter may be approximately 1.5 inches. The base seal mount 134 includes a through hole defining an inner surface 804 having an inner diameter in the range of 0.5-1.25 inches; for example, the inner diameter may be approximately 0.75 inches or 1.125 inches. The through hole defining inner surface 804 is a second passage through which a portion of the firearm barrel 310 passes when the suppressor 100 is mounted to the barrel 310 of the firearm. In some aspects, the inner diameter of the base seal mount 134 is greater than the inner diameter of the mid-seal mount 126 of FIG. 6.

The base seal mount 134 may be further said to have a first face 806 and a second face 808 opposite the first face 806. Though shown as planar, one or more of the first face 806 and the second face 808 may be convex, concave, or any other desirable configuration each of which may have varying effects on the sonic and/or ballistic characteristics of the suppressor. In some aspects, either the first face 806 or the second face 808 of the base seal mount 134 may face towards the discharging end of the suppressor 100.

The base seal mount 134 may be said to have a thickness 810, as measured perpendicular to the first face 806 and/or the second face 808. In some aspects, the thickness 810 may be in the range of 0.25-0.75 inches; for example, the thickness 810 may be approximately 0.375 inches. In some aspects, the outer surface 802 may comprise outer surface threads 812, which, in some aspects, may be configured to mate with the threaded inner surface 118 of the suppressor housing 110 of FIG. 1; for example, the outer surface threads 812 may be UNF threads (e.g., ANSI 1.5 inches nominal with a thread spacing of 12 threads per inch).

The inner surface 804 may comprise inner surface threads 814, for example, configured to receive and mate with a threaded second, rearward portion of the firearm barrel (e.g., the barrel itself, or an external fitting that is coupled to the barrel), such as the firearm barrel 310 of FIGS. 2-3B. Though the inner surface threads 814 may be threaded in any desirable configuration that enables mating to the second, rearward portion of the firearm barrel, in exemplary aspects, the inner surface threads 814 may be UNEF threads (e.g., ANSI 0.75, 1, or 1.125 inches nominal with a thread spacing of 24 threads per inch).

Turning now to FIG. 2, an integrally suppressed firearm barrel system 300 is shown in accordance with one or more embodiments of the present invention. The system 300 comprises the suppressor 100 of FIG. 1 and a firearm barrel 310. The firearm barrel 310 may be of any length, and may be a pistol or rifle barrel, in a range of 4-30 inches. In some aspects, such as aspects where a jurisdiction imposes limits on overall barrel length, the overall length of the system 300 may be in a range of 8-34 inches (e.g., 16 inches). The suppressor 100 portion of the system 300 may comprise any one or more of the features described above with respect to FIGS. 1 and 4-8, in any combination.

Figure 8:
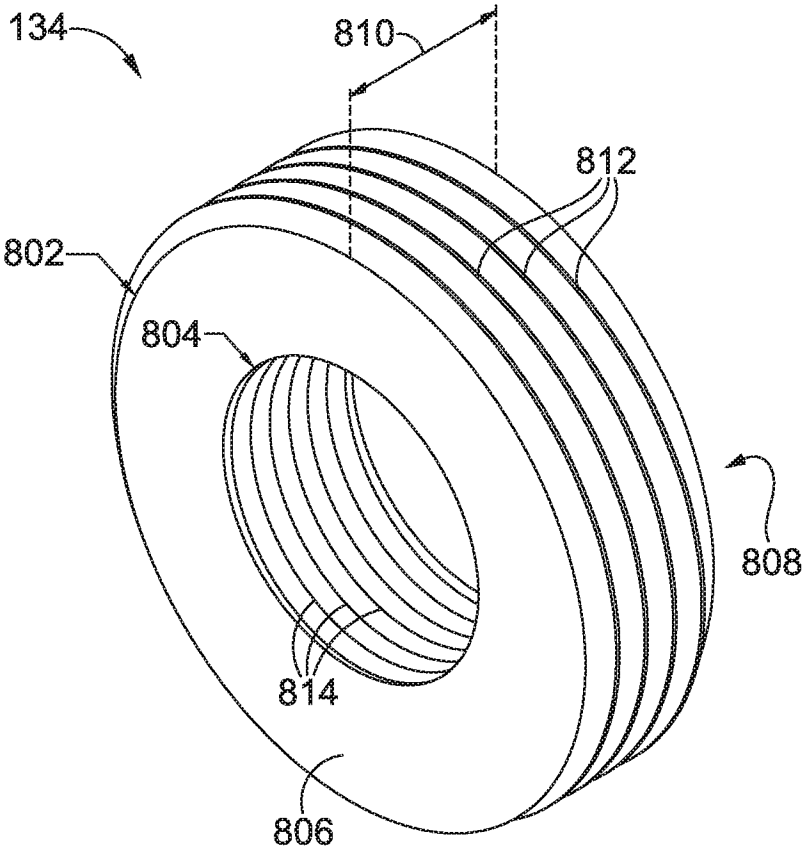
FIG. 8 is a perspective view of a base seal mount, in accordance with one or more embodiments of the present disclosure.

Notably, the suppressor 100 may comprise the mid-seal mount 126 of FIGS. 1 and 6, and the base seal mount 134 of FIGS. 1 and 8. The system 300 is shown in FIG. 2 in an assembled state; that is, the barrel 310 is coupled to the suppressor 100 with at least two points of contact. By providing a system with two points of contact, the system 300 is more likely to remain in the desired alignment, which increases the stability and reliability during use. For example, the two points of contact reduces the chances of the suppressor failing, becoming uncoupled or having misalignment issues, any of which may lead to catastrophic failures during use.

Similar to the suppressor 100 itself, the system 300 may be constructed to be user serviceable or not serviceable; that is, the system 300 may be configured to be capable of disassembly by a user without special tools or without damaging the system 300 or not. In user-serviceable embodiments, the suppressor 100 may be coupled to the firearm barrel 310 only by the mating of the threaded portions at the two points of contact, or it may be additionally held in place via a structure that may be manipulated by the user (e.g., a spring, lever, set screw, or the like). In embodiments that are not user-serviceable, the suppressor 100 may be irremovably coupled to the firearm barrel 310 via a structure such as a weld, pin, chemical adhesive, or the like (which could be in addition to mating of threaded portions at the two points of contact).

The system 300 may be configured for any of a variety of projectile sizes, including 9 mm Luger, .223 caliber, 5.56 mm, 300 Blackout, .308 caliber, and the like. In some aspects, the suppressor 100 may be a multi-caliber suppressor; in other words, the passage defined by the baffles 120 and the inner surfaces of the plurality of suppressor fittings (e.g., the muzzle seal retainer 104, the blast chamber fitting 122, the mid-seal mount 126, the expansion chamber 130, and/or the base seal mount 134) may be larger than the size of the largest projectile configured to be discharged through the firearm barrel 310 (allowing for use with different caliber barrels). In other aspects, the suppressor 100 may be specifically constructed for a single caliber of ammunition such that the passage is approximately equal to the size of the projectile configured to be discharged through the firearm barrel 310 (e.g., in aspects where the barrel 310 is irremovably coupled to the suppressor 100).

The first point of contact exists between a first fitting of the suppressor 100, such as the mid-seal mount 126, and a first threaded portion 312 of the firearm barrel 310. Best seen in the dissembled state depicted in FIG. 3A, the first threaded portion 312 may be threaded in any suitable configuration that mates with the threaded inner surface 614 of the mid-seal mount 126. Like the inner surface 604, in some aspects, the first threaded portion 312 of the firearm barrel may be the native threads of an existing barrel (e.g., the threaded end portion of AR-15 style firearms which conventionally allows for coupling of interchangeable muzzle devices). In other aspects, the first threaded portion 312 may not be native to the firearm barrel and may be threaded at any position on the firearm barrel 310, inasmuch as the distance between the muzzle 302 (best seen in FIG. 3A) and the first threaded portion 312 preferably does not exceed the length of the mid-seal chamber 114.

The second point of contact exists between a second fitting of the suppressor 100, such as the base seal mount 134, and a second threaded portion 314 of the firearm barrel 310. In one embodiment, shown in FIG. 3A, the second threaded portion 314 is directly threaded onto an outer-facing surface of the firearm barrel. In such an aspect, the second threaded portion may be threaded in any configuration that mates with the threaded inner surface 814 of the base seal mount 134.

In another embodiment, shown in FIG. 3B, the second threaded portion 314 comprises an external suppressor adapter 320. The external suppressor adapter 320 may be a disk shaped body that is configured to be placed over/around the firearm barrel 310 and held in place at a second position via an attachment point 324. The attachment point 324 may be of any desirable structural means for holding the external suppressor adapter 320 in place on the firearm barrel 310. For example, if it is desirable that the external suppressor adapter 320 be removable, the attachment point 324 may take the form of a set screw, spring, or the like. In other aspects, if it is desirable that the external suppressor adapter 320 is not removable, the attachment point 324 may take the form of a pin, weld, or the like. In any aspect, the external suppressor adapter 320 will comprise a threaded portion 322 on the outer-facing surface of the external suppressor adapter 320, threaded in any suitable configuration that mates with the threaded inner surface 814 of the base seal mount 134 (best seen in FIG. 3A).

With respect to FIGS. 2-3B, whether the second threaded portion 314 is directly threaded onto the outer-facing surface of the barrel 310 or if the barrel 310 is fitted with an external adapter 320, the second threaded portion 314, positioned at the second position on the firearm barrel 310, may be any non-zero distance 316 from the first position 312, such that the distance 316 is approximately equal to the length of the expansion chamber 116 of the suppressor 100. Further, in some embodiments, such as the embodiment shown in FIGS. 2 and 3A, the second threaded portion 314 may be adjacent to another structure coupled to or incorporated into the firearm barrel 310, such as a gas block 318. In other embodiments, such as the embodiment shown in FIG. 3B, the second threaded portion 314 (depicted in FIG. 3B as the external suppressor adapter 320) may be offset or spaced apart from another structure, such as the gas block 318.

Figure 9:
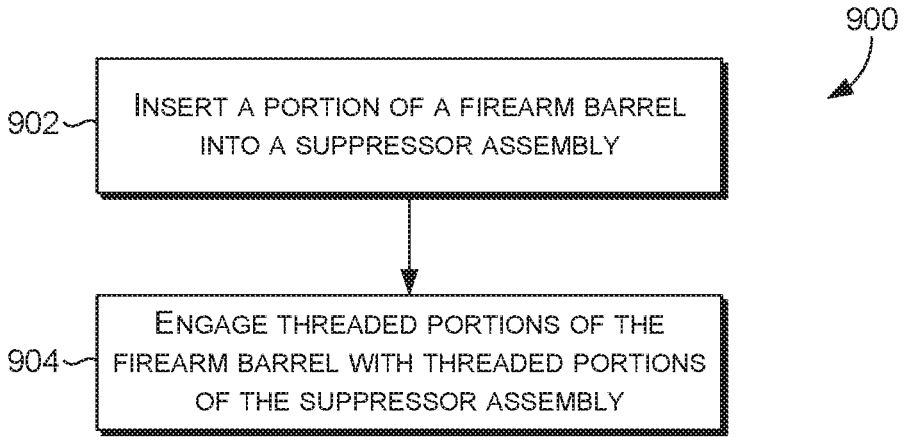
FIG. 9 is an exemplary flow diagram for a method of attaching a suppressor to a firearm barrel, in accordance with one or more embodiments of the present disclosure.

Turning now to FIG. 9, a block diagram is provided illustrating an exemplary method 900 for coupling a suppressor, such as the suppressor 100 shown in FIG. 1, to a barrel of a firearm, such as the barrel 310 shown in FIGS. 2-3B, is provided, in accordance with an embodiment of the present invention. At step 902, a first portion of the barrel of the firearm is inserted in to an end of the suppressor, such as the second end 106 shown in FIG. 1. The suppressor includes a first threaded suppressor component, such as the mid-seal mount 126 shown in FIG. 1, and a second threaded suppressor component, such as the base seal mount 134 shown in FIG. 1. A first longitudinal distance separates the first threaded suppressor component from the second threaded suppressor component; in aspects, the first longitudinal distance may be in the range of 2-8 inches. In other aspects, the first longitudinal distance is any distance greater than zero.

At step 904, a first threaded portion of the barrel of the firearm, such as the first threaded portion 312 shown in FIG. 3A, is engaged with the first threaded suppressor component (such as the mid-seal mount 126 shown in FIGS. 1-3A). In some aspects, the barrel may already comprise the first threaded portion on an outer-facing surface; for example, the first threaded portion may be integrated into the outer-facing surface of the barrel itself or the first threaded portion may be integrated into a first external threading component that is coupled to the outer-facing surface of the barrel. In other aspects, the method described herein may also include the step of providing the threaded portion on the outer-facing surface of the barrel. For example, the outer-facing surface of the barrel itself may be threaded at a first position to create the first threaded portion, wherein the first position and the resulting first threaded portion are proximate to a discharging end (i.e., muzzle) of the barrel.

In another example, a first external threading component may comprise a disk-shaped body that is configured to receive the barrel and be coupled to the outer-facing surface of the barrel. The use of an external threading component may be particularly helpful when retro-fitting existing firearm barrels with the capability of using the suppressor, as it may be done faster and without the need for a skilled gunsmith than threading the exterior of the barrel. The first external threading component may be permanently coupled to the barrel (e.g., spot welding, pinning, and the like), or it may be detachably coupled to the barrel (e.g., via an adjustable set screw that is integrated into the first external threading component). In aspects where the first external threading component is used, the first threaded portion may be provided on an outer-facing surface of the external threading component instead of, or in addition to, threading the barrel, itself.

Further, at step 904, a second threaded portion of the barrel of the firearm, such as the second threaded portion 314 shown in FIG. 3A, is engaged with the second threaded suppressor component. In some aspects, the barrel may already comprise the second threaded portion on its outer-facing surface; for example, the second threaded portion may be integrated into the outer-facing surface of the barrel itself or the second threaded portion may be integrated into a second external threading component that is coupled to the outer-facing surface of the barrel. In other aspects, the method described herein may also include the step of providing the second threaded portion on the outer-facing surface of the barrel, wherein a second longitudinal distance separates the first threaded portion and the second threaded portion, and wherein the first threaded portion is in closer proximity to a muzzle of the barrel of the firearm than the second threaded portion.

In aspects, the first longitudinal distance and the second longitudinal distance are equal. In other aspects, the first longitudinal distance may be within a margin of the second longitudinal distance, such as 10%. In such an aspect, though the first longitudinal distance and the second longitudinal distance may not be equal, the first threaded portion of the barrel may be at least partially engaged with the first threaded component of the suppressor and the second threaded portion of the barrel may be at least partially engaged with the second threaded component of the suppressor.

When providing the second threaded portion, the outer-facing surface of the barrel itself may be threaded at a second position to create the second threaded portion. In other aspects, the second external threading component may comprise a disk-shaped body that is configured to receive the barrel and be coupled to the outer-facing surface of the barrel. Like the first external threading component, the second external threading component may be permanently coupled to the barrel or it may be detachably coupled to the barrel. In aspects where the second external threading component is used, the second threaded portion may be provided on an outer-facing surface of the external threading component instead of, or in addition to, threading the barrel itself.

In some embodiments the second threaded portion of the barrel of the firearm engages with the second threaded suppressor component simultaneously with the first threaded portion of the barrel of the firearm engaging with the first threaded suppressor component. In such an embodiment, the first longitudinal distance is equal to the second longitudinal distance. In other embodiments the first longitudinal distance may be different from the second longitudinal distance. In such an embodiment one of the threaded portions of the barrel may engage with its corresponding threaded suppressor component before the other threaded portion of the barrel engages with its corresponding threaded suppressor component.

The subject matter of this disclosure has been described in relation to particular embodiments, which are intended in all respects to be illustrative rather than restrictive. Alternative embodiments will become apparent to those of ordinary skill in the art to which the present subject matter pertains without departing from the scope hereof. Different combinations of elements, as well as use of elements not shown, are also possible and contemplated and are within the scope of the present invention.

What is claimed is:

1. An apparatus for reducing an audible report of a firearm, the apparatus being coupleable with a barrel of the firearm, the apparatus comprising:

a tubular housing having a first end and a second end opposite the first end, the first end configured for discharging a projectile fired by the firearm and the second end configured to receive the barrel of the firearm;

a first disk shaped body disposed within the tubular housing in a first position and having a first through hole defining a first inner surface and at least one aperture extending through the first disk shaped body from a first face of the first disk shaped body to a second face of the first disk shaped body, the first face of the first disk shaped body opposite the second face of the first disk shaped body, wherein at least a portion of the first inner surface is threaded and configured to mate with a first threaded portion of the firearm barrel; and a second disk shaped body having a first face and a second face opposite the first face, disposed within the tubular housing in a second position and having a second through hole defining a second inner surface, at least a portion of the second inner surface being threaded and configured to mate with a second threaded portion of the firearm barrel to sealingly engage with the second threaded portion of the firearm barrel at each of the first face and the second face of the second disk shaped body, wherein the first position and the second position are spaced apart by a first longitudinal distance, the first longitudinal distance defining an expansion chamber within the tubular housing, and wherein the first position is nearer the first end than the second position;

a third disk shaped body disposed within the tubular housing in a third position and having a third through hole defining a third inner surface, the third position being between the first position and the second position; and a fourth disk shaped body disposed within the tubular housing at the first end of the tubular housing consisting of a single fourth through hole fitting defining a fourth inner surface.

2. The apparatus of claim 1, wherein the third disk shaped body further comprises a plurality of through-hole apertures proximate the third through hole.

3. The apparatus of claim 2, wherein at least a portion of an inner surface of the tubular housing is threaded.

4. The apparatus of claim 3, wherein at least a portion of an outer surface of the third disk shaped body is threaded, wherein the outer surface of the third disk shaped body is configured to mate with the inner surface of the tubular housing.

5. The apparatus of claim 4, wherein the third position is adjustable along the first longitudinal distance.

6. The apparatus of claim 1, wherein the third position is fixed.

7. The apparatus of claim 1, wherein at least a portion of the fourth inner surface being is threaded.

8. The apparatus of claim 7, wherein the apparatus further comprises a muzzle device adapter, the muzzle device adapter being a tubular body having an outer surface and an inner surface, and having a first end and a second end opposite the first end, wherein at least a portion of the outer surface of the first end of the muzzle device adapter is threaded, and wherein at least a portion of the outer surface of the second end of the muzzle device adapter is threaded and configured to mate with at least a portion of the threaded fourth inner surface.

9. The apparatus of claim 8, wherein the threaded portion of the outer surface of the first end of the muzzle device adapter comprises threads in a range of 0.5-1 inch nominal and having a thread spacing in a range of 20-32 threads per inch.

10. The apparatus of claim 7, wherein the apparatus further comprises a plurality of baffles disposed in the tubular housing between the first disk shaped body and the fourth disk shaped body.

11. The apparatus of claim 1, wherein the apparatus further comprises a portion of wire mesh, the portion of wire mesh being disposed between the first disk shaped body and the second disk shaped body.

12. An integrally suppressed firearm barrel system, the system comprising:

a suppressor, the suppressor comprising:

a housing having a first end and a second end opposite the first end, the first end configured for discharging a projectile fired by a firearm and the second end configured to receive the barrel of the firearm;

a first barrel receiving fitting disposed at a first position within the housing, the first barrel receiving fitting having a threaded through hole that defines a first inner surface and at least one aperture extending through the first disk shaped body from a first face of the first disk shaped body to a second face of the first disk shaped body, the first face of the first disk shaped body opposite the second face of the first disk shaped body; and a second barrel receiving fitting disposed at a second position within the housing, the second barrel receiving fitting having a threaded through hole that defines a second inner surface, wherein the second barrel receiving fitting is configured to sealingly engage with a second threaded portion of a firearm barrel at each of a first face and a second face of the second barrel receiving fitting;

a third disk shaped body disposed within the housing in a third position and having a third through hole defining a third inner surface, the third position being between the first position and the second position; and a fourth disk shaped body disposed within the housing at the first end of the housing consisting of a single fourth through hole fitting defining a fourth inner surface; and the firearm barrel, the firearm barrel comprising:

a first threaded portion, wherein the first threaded portion is on an outer-facing surface of the firearm barrel at a first position; and the second threaded portion at a second position, the first position being nearer the first end of the housing than the second position;

wherein a distance separates the first threaded portion from the second portion, and wherein at least a portion of the first barrel receiving fitting is configured to receive and mate with the first threaded portion of the firearm barrel and the second barrel receiving fitting is configured to receive and mate with the second threaded portion of the firearm barrel.

13. The system of claim 12, further comprising a gas block on the firearm barrel, wherein the second threaded portion is adjacent to the gas block.

14. The system of claim 12, wherein the second threaded portion is a threaded outer surface of a suppressor adapter, and where the suppressor adapter is a disk shaped body coupled to an outer-facing surface of the firearm barrel at the second position.

15. The system of claim 12, wherein the second threaded portion is an outer-facing surface of the firearm barrel at the second position.

16. The system of claim 12, wherein the system further comprises a muzzle device adapter, wherein the muzzle device adapter has a tubular body with an outer surface and an inner surface, and having a first end and a second end opposite the first end, wherein at least a portion of the outer surface of the first end of the muzzle device adapter is threaded, wherein the second end of the muzzle device adapter is coupled to the suppressor, and wherein the threaded portion of the outer surface of the first end of the muzzle device adapter has threads in a range of 0.5-1 inch nominal and a thread spacing in a range of 20-32 threads per inch.

17. A method for coupling a suppressor to a barrel of a firearm, the method comprising:

inserting a first portion of the barrel of the firearm into a first portion of a suppressor housing, the suppressor housing comprising a first threaded suppressor component and a second threaded suppressor component;

engaging a first threaded portion of the barrel of the firearm with the first threaded suppressor component, the first threaded suppressor component disposed within the tubular housing in a first position and having a first through hole defining a first inner surface and at least one aperture extending through the first disk shaped body from a first face of the first disk shaped body to a second face of the first disk shaped body, the first face of the first disk shaped body opposite the second face of the first disk shaped body; and engaging a second threaded portion of the barrel of the firearm with the second threaded suppressor component, the second threaded suppressor component having a first face and a second face opposite the first face and disposed within the tubular housing in a second position, wherein the second threaded suppressor component comprises a second through hole defining a second inner surface, at least a portion of the second inner surface being threaded and configured to mate with a second threaded portion of the firearm barrel to sealingly engage with the second threaded portion of the barrel of the firearm at each of the first face and the second face of the second disk shaped body, wherein the suppressor further comprises:

a third disk shaped body disposed within the suppressor housing in a third position and having a third through hole defining a third inner surface, the third position being between the first position and the second position, and a fourth disk shaped body disposed within the suppressor housing at a discharging end of the suppressor housing, consisting of a single fourth through hole fitting defining a fourth inner surface.

18. The method of claim 17, further comprising threading the barrel of the firearm at a first position to create the first threaded portion.

19. The method of claim 17, wherein the method further comprises threading the barrel of the firearm at a second position to create the second threaded portion, wherein a first distance separates the first threaded portion and the second threaded portion, and wherein the first threaded portion is closer in proximity to a muzzle of the barrel of the firearm than the second threaded portion.

* * * * *